United States Patent [19]

Hennig

[11] Patent Number: 4,657,174

[45] Date of Patent: Apr. 14, 1987

[54] FOLDING CARTON WITH A POURING OPENING

[75] Inventor: Horst Hennig, Kempten, Fed. Rep. of Germany

[73] Assignee: Lever Brothers Company, New York, N.Y.

[21] Appl. No.: 692,733

[22] Filed: Jan. 18, 1985

[30] Foreign Application Priority Data

Jan. 21, 1984 [DE] Fed. Rep. of Germany ..... 3402096

[51] Int. Cl.[4] ..... B65D 5/54

[52] U.S. Cl. ..... 229/17 R; 206/621; 206/626

[58] Field of Search ..... 229/7 R, 17 R, 37 R; 206/607, 611, 626, 620, 621, 628

[56] References Cited

U.S. PATENT DOCUMENTS

| | | | |
|---|---|---|---|
| Re. 25,532 | 3/1964 | Asman | 229/17 R |
| 2,097,647 | 11/1937 | Scott | 229/7 R |
| 2,251,283 | 8/1941 | Johnson | 229/17 R |
| 3,123,275 | 3/1964 | Bunger | 229/17 R |
| 3,133,688 | 5/1964 | Asman | 229/17 R |
| 3,147,907 | 9/1964 | Hartvig-Johansen | 229/17 R |
| 3,982,683 | 9/1976 | Forteau | 229/17 R |

FOREIGN PATENT DOCUMENTS

| | | | |
|---|---|---|---|
| 1218339 | 6/1966 | Fed. Rep. of Germany | 229/17 R |
| 8304507A | 11/1983 | Fed. Rep. of Germany . | |
| 3307758 | 9/1984 | Fed. Rep. of Germany | 229/17 R |
| 2535685 | 5/1984 | France | 229/17 R |
| 7415376 | 5/1976 | Netherlands | 229/17 R |
| 732682 | 6/1955 | United Kingdom . | |
| 1451142 | 9/1976 | United Kingdom | 206/621 |

*Primary Examiner*—William Price
*Assistant Examiner*—Gary E. Elkins
*Attorney, Agent, or Firm*—Milton L. Honig; James J. Farrell

[57] ABSTRACT

A folding carton with a pouring opening, which is torn open with the help of a perforation line. The folding lines and the sections of the folding carton panels divided off by the same are arranged and designed in such a way that the pouring opening remains in both its opened and its reclosed position without any assistance.

1 Claim, 7 Drawing Figures

FOLDING CARTON WITH A POURING OPENING

BACKGROUND OF THE INVENTION

The invention relates to a folding carton with a pouring opening, which is located in one corner of the folding carton between one narrow side panel and the top panel of the folding carton, with a perforation line to tear the folding carton open in this corner and with a number of folding or similar lines to fold at least one section of the narrow side panel out of the plane of this panel, the section that can be folded out being divided off from the rest of the narrow side panel by a folding line and a section of the top panel that is adjacent to said section being divided off by a straight folding line.

DE-GM No. 83 04 507 discloses such a folding carton. Since it has a pouring opening, it does, however, require a relatively large amount of board. Apart from this, the blank has an extremely complicated design and the opened folding carton does not remain open without assistance. On the contrary, it is necessary to exert constant lateral pressure on the pouring opening in order to keep it open.

SUMMARY OF THE INVENTION

The purpose of the invention is to create a folding carton with a pouring opening that does not require more material than a folding carton without a pouring opening, that has a simple design and is therefore easy to produce and that has a pouring opening which remains open on its own.

The way the present invention achieves this purpose is to connect the ends of each of the two folding lines that extend across the narrow side panel and the top panel by a crease line that extends diagonally across the side panels of the folding carton, to have a folding line starting from each of these ends which extends diagonally across the section of the narrow side panel and the top panel and divides a triangular area off from the same, each pair of these folding lines meeting at least approximately at points located on the edge joining the top panel and the narrow side panel, these two points being located a distance apart, to have the perforation line for tearing open the folding carton consist of one middle section running parallel to and a certain distance from the edge joining the narrow side panel and the top panel and two side sections starting from the middle section and extending to the two ends of the edge joining the narrow side panel and the top panel, and to make the folding line that divides the section that can be folded out off from the rest of the narrow side panel curve downwards.

This design has the additional advantage that the pouring opening is relatively tight when it is reclosed. Simple exertion of pressure on the sections that are folded out snaps these sections inwards where they rest against each other and give each other mutual support. This closes the pouring opening in such a way that it is not forced open even by the pressure exerted by the product.

BRIEF DESCRIPTION OF THE INVENTION

One embodiment of the invention is shown in the drawing.

FIG. 1 shows a folding carton with a pouring opening at one top corner.

FIG. 2 shows in a larger scale the corner of the folding carton shown in FIG. 1 in which the pouring opening (closed) is located, FIG. 3 shows the corner of the folding carton shown in FIG. 2 with the pouring opening partly open, FIG. 4 shows the corner shown in FIGS. 2 and 3 with the pouring opening completely open, FIG. 5 shows the pouring opening when it has been partly closed again, FIG. 6 shows the corner of the folding carton with the pouring opening closed again and FIG. 7 shows a flat board blank used to produce a folding carton as shown in FIG. 1.

DETAILED DESCRIPTION OF THE INVENTION

Figure 1:
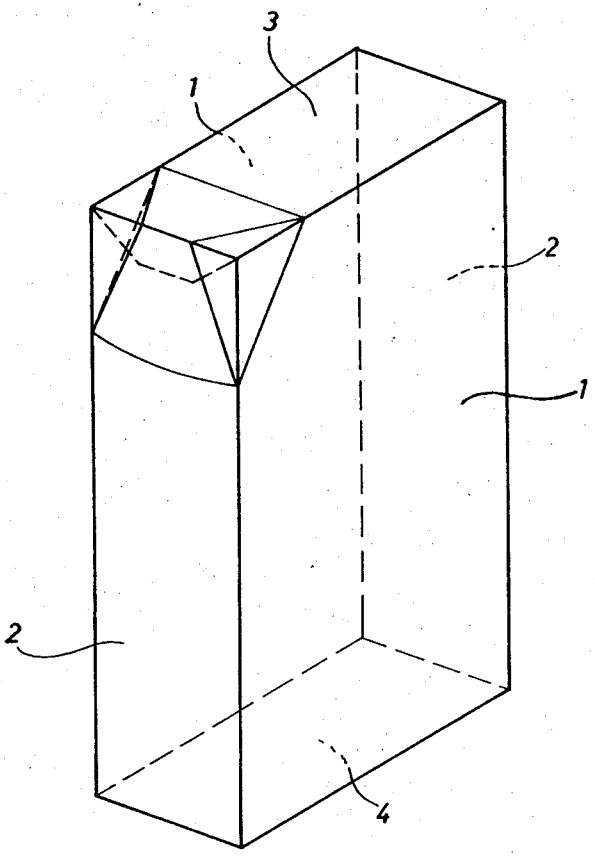

FIG. 1 shows a folding carton which has two side panels 1, two narrow side panels 2, a top panel 3 and a base 4.

Figure 2:
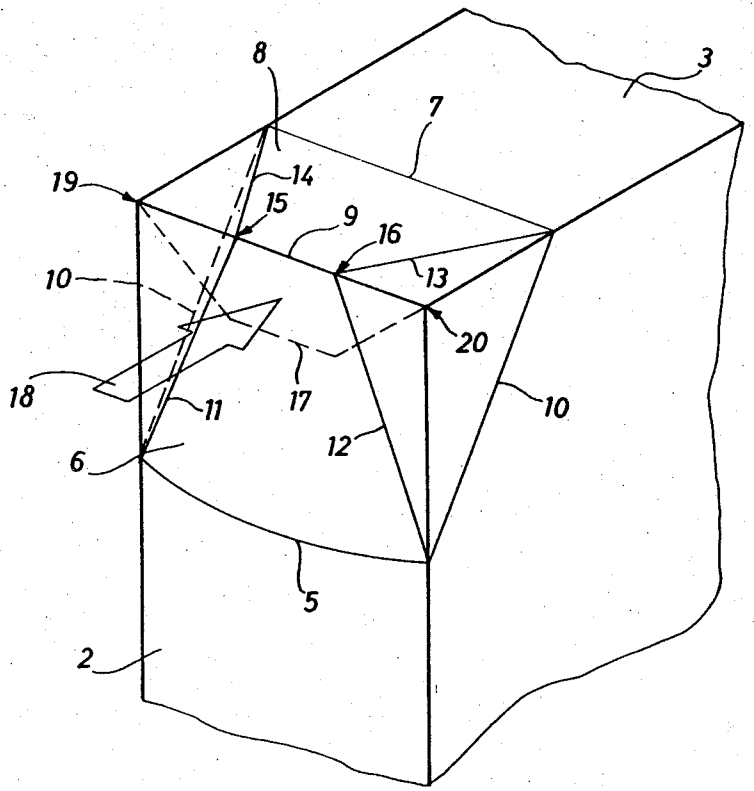

As FIG. 2 in particular shows, one narrow side panel 2 has a folding line 5 which is curved downwards and divides a section 6 which can be folded out off from the narrow side panel 2. A folding line 7 extends across the top panel 3 and divides off from this top panel 3 a further section 8, which is connected to section 6 of the narrow side panel by edge 9 of the folding carton. Each of the ends of these two folding lines 5 and 7 are connected by a crease line 10 that extends diagonally across side panels 1. Folding lines 11, 12, 13 and 14, which extend diagonally across section 6/8 and end at two points 15 and 16 on edge 9 also start from these ends. These two points 15 and 16 are located a distance apart that roughly corresponds to the distance they are away from the outside edge of the folding carton.

The middle section of a perforation line 17, the two side sections of which end at the ends 19 and 20 of edge 9, runs parallel to and at a certain distance from edge 9 within section 6 of narrow side panel 2.

The folding carton is opened by pressing in the direction of the arrow 18 on the area of section 6 located between perforation line 17 and edge 9, thus tearing open the perforation line. As a result of this, the area pressed moves inwards and rests against the underneath of section 8.

Figure 4:
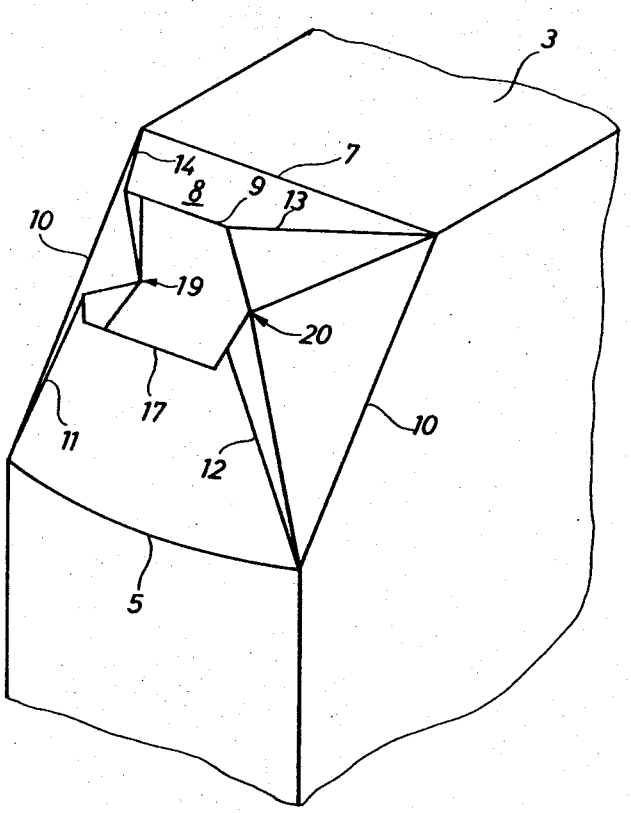
Figure 3:
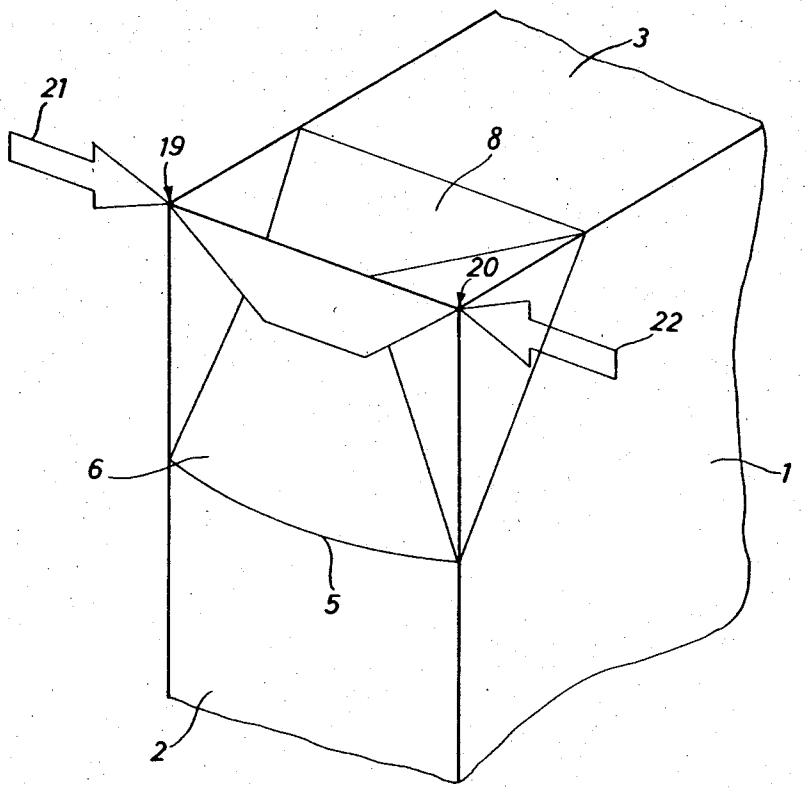

This position is shown in FIG. 3. If pressure is now exerted in the direction of the two arrows 21 and 22 on the two ends 19 and 20, section 8 moves upwards and section 6 moves outwards, so that the pouring opening reaches the position shown in FIG. 4.

Pre-tensioning of the board material and, in particular, the curved shape of folding line 5 mean that this position is maintained even when the lateral pressure (arrows 21, 22,) is released, so that the contents of the folding carton can be poured out without any difficulty.

Figure 6:
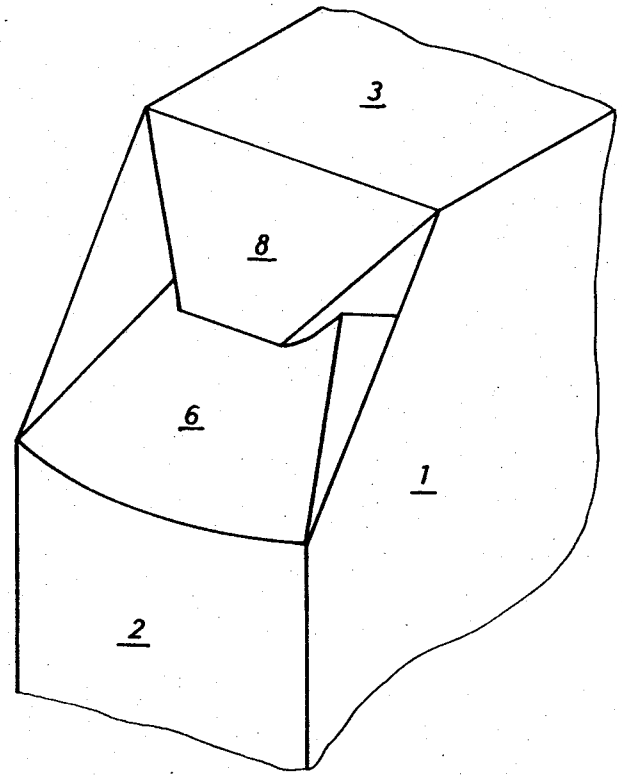
Figure 5:
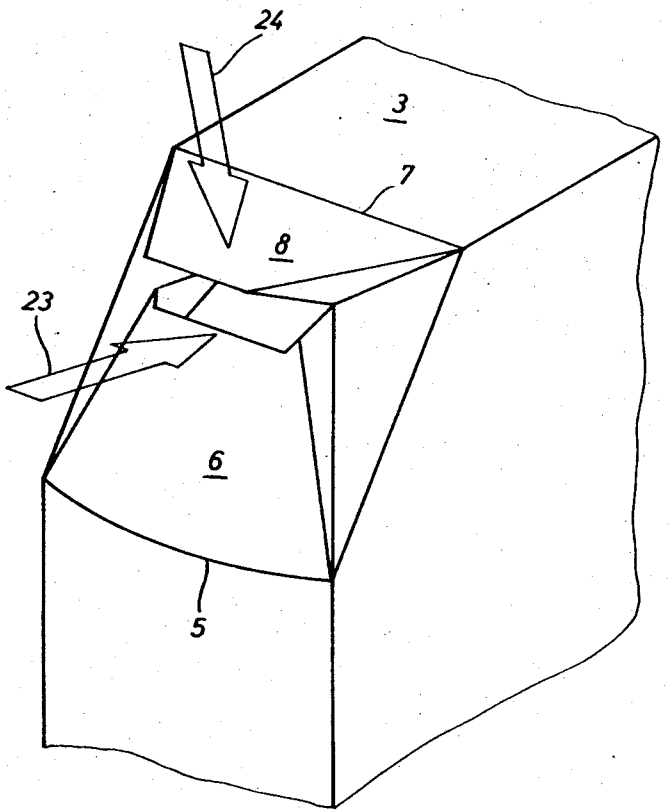

The pouring opening is closed again by exerting pressure in the direction of arrows 23 and 24 on the two sections 6 and 8, as is shown in FIG. 5. Sections 6 and 8 and the areas connected to them then adopt the position shown in FIG. 6, where section 8 of top panel 3 rests on section 6 of narrow side panel 2. The pouring opening is relatively tightly closed in this position and only opens again when section 8 is pulled, in view of the tensioning of the material.

Figure 7:
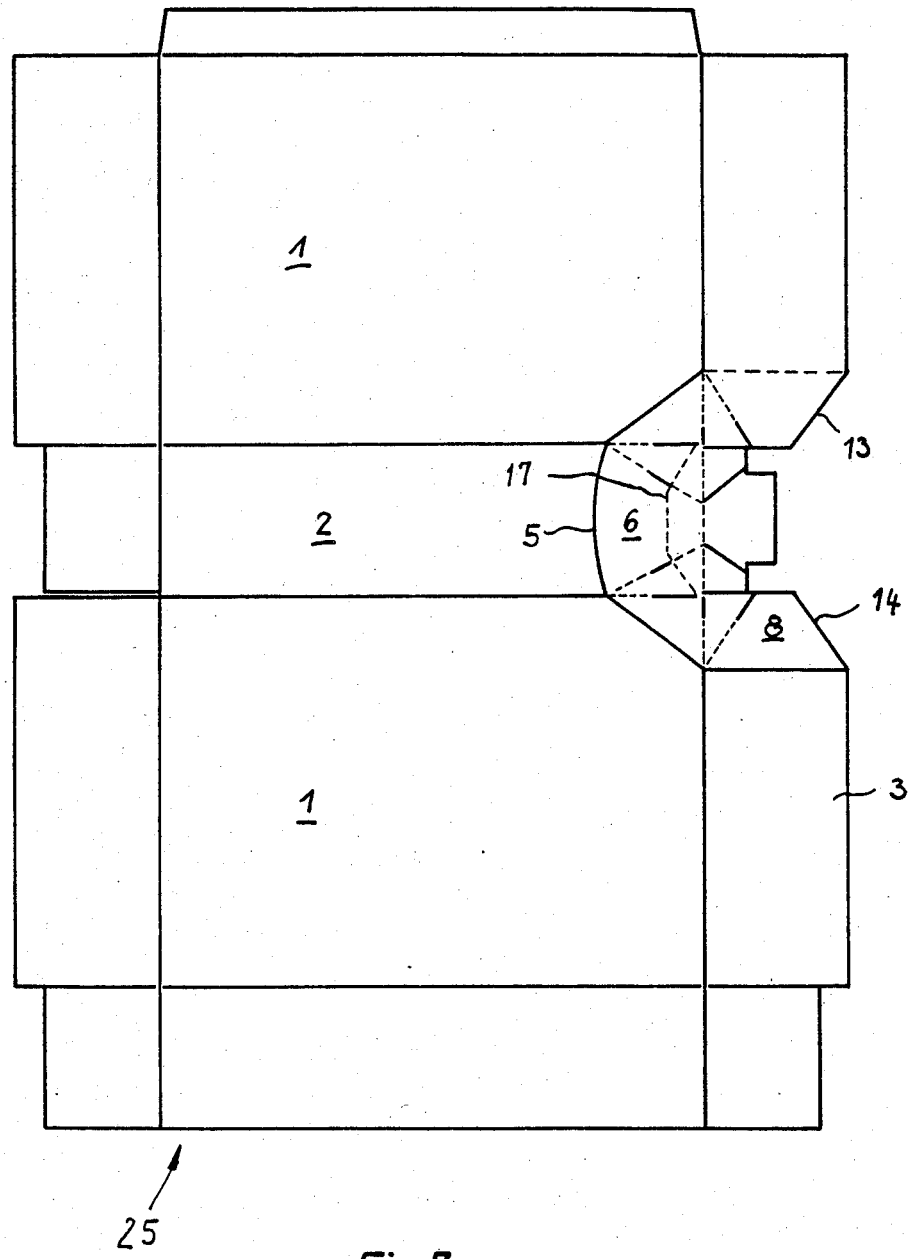

The blank 25 shown in FIG. 7 represents a particularly effective design, also as regards the arrangement of the closure seams. The pouring opening in accordance with the present invention can, however, also be realized with other blank designs.

I claim:

1. A folding carton having a top panel, first and second side panels, first and second narrow side panels, a bottom panel, and a pouring opening, which pouring opening is located in one corner of said folding carton between said first narrow side panel and said top panel, with a perforation line to tear said folding carton open in said corner and a plurality of folding lines, including first and second straight folding lines, first and second diagonal crease lines and a plurality of oblique folding lines, to fold at least one section of said first narrow side panel out of the plane of said first narrow side panel, said section that can be folded out being divided from the rest of said first narrow side panel by said first straight folding line extending across said first narrow side panel and a section of said top panel that is adjacent to said section that can be folded out from said first narrow side panel being divided off from the rest of said top panel by said second straight folding line extending across said top panel, wherein the ends of said two straight folding lines that extend across said narrow side panel and said top panel are connected by said first and said second crease lines which extend diagonally across said first and second side panels respectively of said folding carton, wherein said plurality of oblique folding lines (11, 12 and 13, 14) start from each of said ends, which extend diagonally across the sections of said first narrow side panel and said top panel respectively, and divide a triangular area off from each of said first narrow side panel and said top panel, said plurality of oblique folding lines (11, 14 and 12, 13) meeting at least approximately at points (15 and 16) located on an edge (9) joining said top panel and said first narrow side panel, said points (15, 16) being located a distance apart, wherein said perforation line for tearing open the folding carton consists of one middle section running parallel to and a certain distance from the edge joining the said first narrow side panel and said top panel and two side sections starting from said middle section and extending to a first end (19) and a second end (20) of said edge (9) joining said first narrow side panel and said top panel, and wherein the folding line that divides the section that can be folded out from the rest of said first narrow side panel curves downwards, said folding carton in its assembled form, with said pouring opening in a closed configuration and said perforation line not yet torn, having a flat top surface formed by said top panel with protrusions beyond a plane defined by said surface absent therefrom.

* * * * *